US006920930B2

(12) United States Patent
Allamon et al.

(10) Patent No.: US 6,920,930 B2
(45) Date of Patent: Jul. 26, 2005

(54) DROP BALL CATCHER APPARATUS

(75) Inventors: Jerry P. Allamon, Montgomery, TX (US); Jack E. Miller, Houston, TX (US)

(73) Assignee: Allamon Interests, Montgomery, TX (US)

( * ) Notice: Subject to any disclaimer, the term of this patent is extended or adjusted under 35 U.S.C. 154(b) by 11 days.

(21) Appl. No.: 10/315,666

(22) Filed: Dec. 10, 2002

(65) Prior Publication Data

US 2004/0108109 A1 Jun. 10, 2004

(51) Int. Cl.[7] ..... E21B 34/14
(52) U.S. Cl. ..... 166/318; 166/332.4; 166/332.8
(58) Field of Search ..... 166/373, 374, 166/381, 316, 318, 317, 332.4, 332.8; 175/317

(56) References Cited

U.S. PATENT DOCUMENTS

| | | | | |
|---|---|---|---|---|
| 3,913,675 A | | 10/1975 | Smyrl | 166/278 |
| 4,031,957 A | | 6/1977 | Sanford | 166/264 |
| 4,457,376 A | * | 7/1984 | Carmody et al. | 166/332.8 |
| 4,566,541 A | | 1/1986 | Moussy et al. | 166/318 |
| 4,729,432 A | | 3/1988 | Helms | 166/317 |
| 4,823,882 A | | 4/1989 | Stokley et al. | 166/387 |
| 4,828,037 A | | 5/1989 | Lindsey et al. | 166/382 |
| 4,893,678 A | | 1/1990 | Stokley et al. | 166/374 |
| 5,890,538 A | | 4/1999 | Beirute et al. | 166/285 |
| 5,960,881 A | | 10/1999 | Allamon et al. | 166/291 |
| 6,053,250 A | | 4/2000 | Echols | 166/317 |
| 6,125,930 A | | 10/2000 | Moyes | 166/66 |
| 6,155,350 A | | 12/2000 | Melenyzer | 166/374 |
| 6,547,007 B2 | * | 4/2003 | Szarka et al. | 166/317 |
| 6,725,935 B2 | * | 4/2004 | Szarka et al. | 166/318 |

* cited by examiner

*Primary Examiner*—David Bagnell
*Assistant Examiner*—Matthew J. Smith

(57) ABSTRACT

A drop ball catcher apparatus for use with downhole tools in oil well drilling and installation operations. A drop ball catcher apparatus is used to receive and stow a drop ball ejected from a ball-actuated downhole tool.

24 Claims, 10 Drawing Sheets

DROP BALL CATCHER APPARATUS

BACKGROUND OF THE INVENTION

1. Field of the Invention

The present invention relates to an apparatus for use in the oil well industry, and, more particularly, to a drop ball catcher apparatus for use with downhole tools in oil well drilling and installation operations.

2. Description of the Prior Art

Drop ball mechanisms are used in oil well drilling and installation operations typically to activate downhole tools. In U.S. Pat. No. 6,467,546, for example, a drop ball mechanism is disclosed for use in activating downhole tools and devices, namely: float equipment, flapper valves, squeeze tools, inflatable packers, running tools, adaptors, test tools, and the like. The drop ball apparatus of the '546 patent includes a drop ball and a yieldable ball seat. The yieldable ball seat is attached to an inner sleeve arranged within a downhole tool. The downhole tool is generally suspended in a borehole on a tubular string such as a drill string. To activate the downhole tool, a ball having a diameter larger than the diameter of the yieldable seat is dropped from the surface through the tubular string and into the downhole tool where it lands in the yieldable seat. The ball plugs the yieldable seat such that communication through the seat is interrupted. Drilling fluid pressure is then increased above the ball to displace the inner sleeve axially downward thereby activating the tool. In one embodiment of the '546 patent, shifting the inner sleeve axially downward launches a second ball having a diameter larger than the drill string to activate a set of flapper valves in a float collar. Once the tool is activated, drilling fluid pressure is again increased above the first ball to force the ball through the yieldable seat and out of the tool to the bottom of the borehole.

In U.S. Pat. No. 6,155,350, assigned on its face to Baker Hughes Inc., a ball seat mechanism is disclosed for use in downhole oil well tools which are also actuated by pressure build-up means. The ball seat mechanism of the '350 patent includes a ball and a ball seat supported by a rupture disc and attached to a tubular string by a set of shear pins. To actuate the downhole tool, the ball is dropped through the tubular string and into the seat to obstruct passage through the seat. Pressure is then increased by means at the surface to a predetermined level to break the rupture disc and thus shear the shear pins. The ball and seat are then displaced from the tubular string to reestablish passage.

In U.S. Pat. No. 5,960,881, a yieldable ball seat is disclosed for shifting a diverter tool used to faciliatate surge pressure reduction while running a casing liner down a borehole. The ball seat of the '881 patent is designed to yield at a particular pressure. To shift the surge pressure reduction diverter tool, a ball is dropped through a drill string to land in the yieldable seat. Drilling mud is then pressurized to a first predetermined level above the ball to shift the diverter tool from an open port position to a closed port position. Next, the drilling mud is pressurized to a second predetermined level above the ball to force the ball through the yieldable seat and out of the casing liner to land at the bottom of the borehole.

While current drop ball systems—such as those described above—provide a reliable means for actuating downhole tools, these systems do not account for the drop ball itself once the tool has been activated. Rather, in current drop ball-actuated systems, the drop ball is displaced from the downhole tool where it falls to the bottom of the wellbore.

However, at the bottom of the wellbore, the drop ball becomes an obstacle for the drill bit to break up as drilling operations are resumed. This of course expends valuable time and resources.

Accordingly, the oil well industry would find desirable a drop ball apparatus for activating a downhole tool while promoting drilling operation efficiency by minimizing the proliferation of downhole debris caused by ejecting the drop ball into the wellbore. This novel and useful result has been achieved by the present invention.

SUMMARY OF THE INVENTION

In accordance with the present invention, drop ball catcher apparatus for use with downhole tools in oil well drilling and installation operations is provided.

The drop ball catcher apparatus in accordance with the present invention is used with a ball-actuated downhole tool suspended in a borehole on a tubular string. The drop ball catcher apparatus may be used with any downhole tool requiring drop ball activation including, but not limited to: downhole circulating tools, diverter tools, float equipment, flapper valves, squeeze tools, inflatable packers, running tools, adaptors, test tools, and the like. In an embodiment of the present invention, a drop ball catcher apparatus is operatively connected to the lower end of a downhole tool to receive and stow a drop ball once it is ejected from the downhole tool.

The drop ball catcher apparatus of the present invention includes a housing with an axial bore therethrough for establishing communication between the tubular string and the wellbore. The housing includes an annular recess with a diameter greater than the diameter of the axial bore of the housing.

The drop ball catcher apparatus of the present invention further includes a sliding sleeve residing within the axial bore of the housing above the recess. A ball seat having an axial bore therethrough is arranged below the lower end of the sliding sleeve. The ball seat is a receptacle for receiving and holding the drop ball that was used to activate the downhole tool. Moreover, the ball seat is moveable between: (1) a first position where the ball seat prevents the sliding sleeve from displacing axially downward, and (2) a second position where the ball seat is located in the recess of the housing and out of engagement with the sliding sleeve to allow the sliding sleeve to displace axially downward.

The drop ball catcher apparatus of the present invention still further includes a bracket for attaching the seat to the housing, a pivot pin on which the seat rotates between the first position and second position, and a shear pin for latching the ball seat in the first position.

The drop ball catcher apparatus of the present invention also includes a drop ball for interrupting communication through the axial bore of the housing via the ball seat.

It is an object of the drop ball catcher apparatus of the present invention to minimize the proliferation of downhole debris caused by ejecting the drop ball into the wellbore.

It is an object of the drop ball catcher apparatus of the present invention to create a nonobstructed full bore flow path via the axial bore of the downhole tool.

DESCRIPTION OF SPECIFIC EMBODIMENTS OF THE INVENTION

A description of certain embodiments of the present invention is provided to facilitate an understanding of the invention. This description is intended to be illustrative and not limiting of the present invention. While the drop ball catcher apparatus is described in connection with a ball-actuated diverter tool, it is intended that the drop ball catcher apparatus may be used with any ball-actuated downhole tool.

Figure 1:
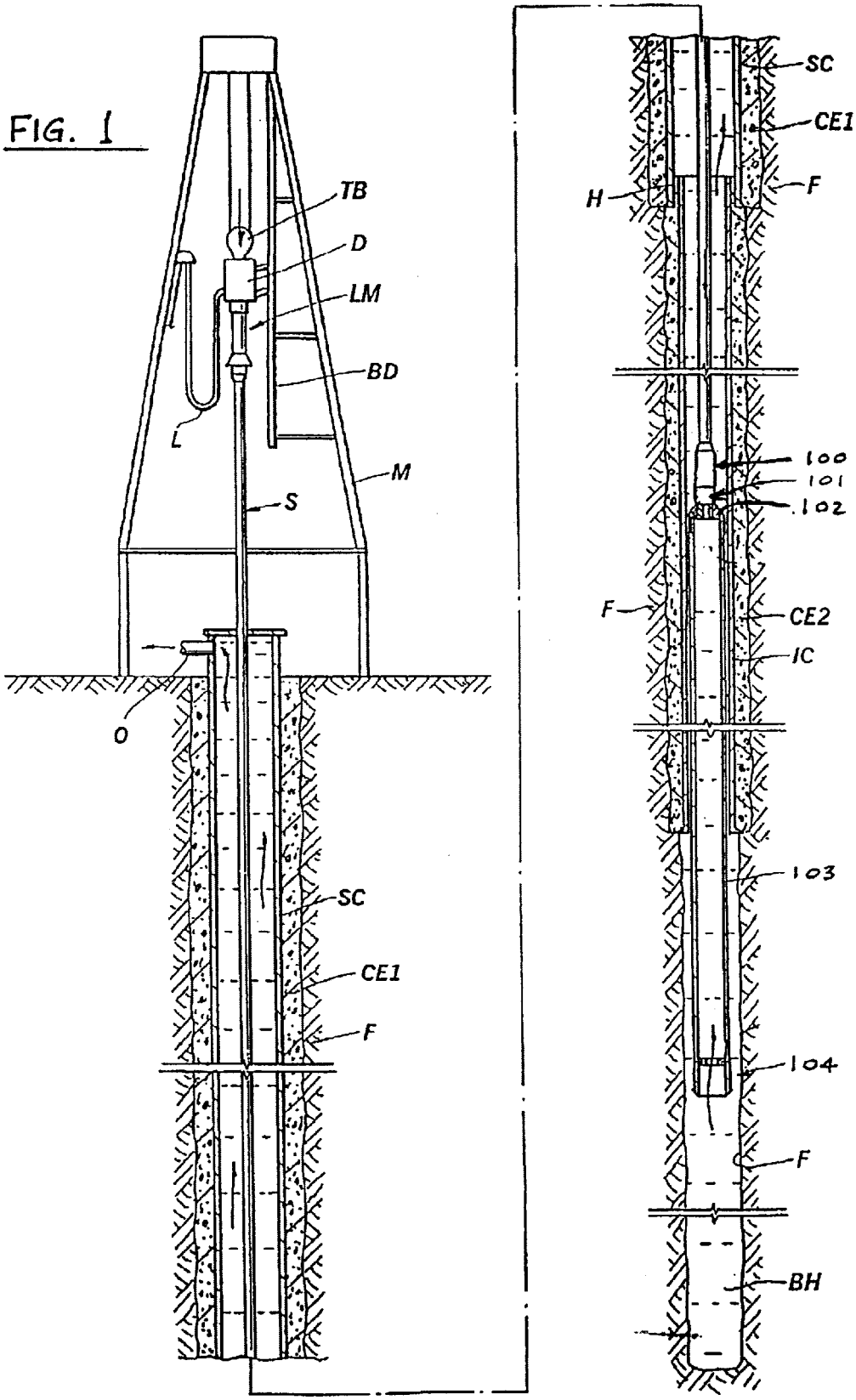
FIG. 1 is an elevation view of a wellbore depicting a drilling/production liner being run downhole with a drop ball catcher device in accordance with the present invention.

With reference first to FIG. 1, the general components of a system in which a tool in accordance with the present invention is used are illustrated. A mast M suspends a traveling block TB. The traveling block, in turn, supports a top drive TD which moves vertically on a block dolly BD. An influent drilling fluid line L supplies the top drive TD with drilling fluid from a drilling fluid reservoir (not shown). A launching manifold LM connects to a drill string S. The drill string S comprises numerous pipe elements which extend down into the borehole BH, and the number of such pipes is dependent on the depth of the borehole BH. A surge pressure reduction bypass device or "diverter tool" 100 is operatively connected to the bottom end of drill string S. A drop ball catcher apparatus 101 in accordance with the present invention is operatively connected between the lower end of the diverter tool 100 and a hanger 102 for installing a drilling/production liner 103. The drilling/production liner 103 is suspended from hanger 102. An open guide shoe 104 is fastened to the bottom of the hanger 102.

Solidified cement CE1 fixes a surface casing SC to the surrounding formation F. The surface casing SC contains an opening O in the uppermost region of the casing adjacent to the top. The opening O controls return of drilling fluid as it travels up the annulus between the drill string S and the surface casing SC.

Solidified cement CE2 fixes an intermediate casing IC to the surrounding formation F. The intermediate casing IC is hung from the downhole end of the surface casing SC by a mechanical or hydraulic hanger H.

Figure 2:
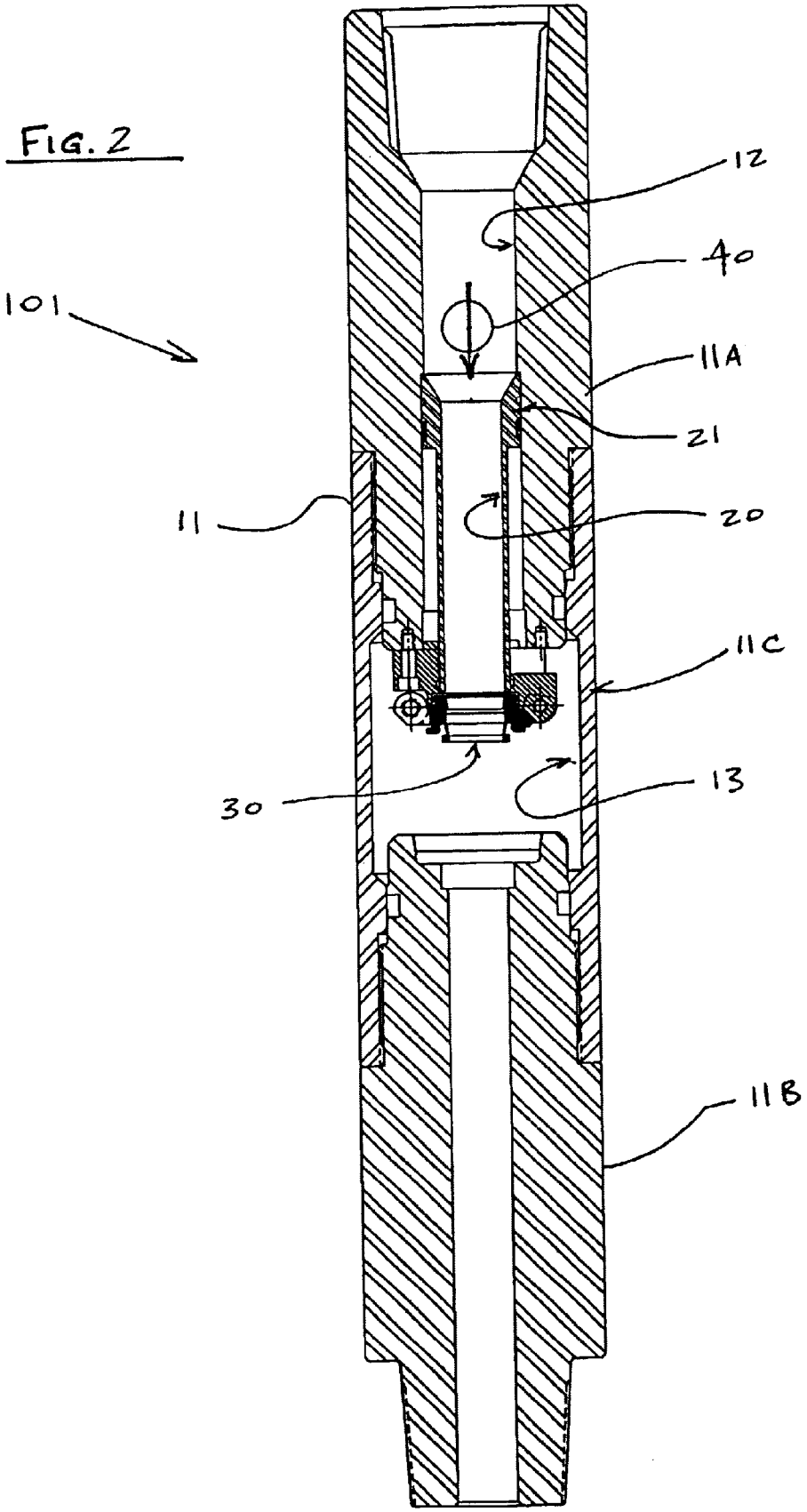
FIG. 2 is an elevation view of an embodiment of the present invention depicting a drop ball being released into the drop ball catcher.

Referring to FIG. 2, the general components of a drop ball catcher apparatus 101 in accordance with the present invention are illustrated. The drop ball catcher apparatus includes a housing assembly 11 with a top end operatively connected to the diverter tool 100 (FIG. 1) and a bottom end operatively connected to the drilling/production liner 103 (FIG. 1). The housing assembly 11 comprises an upper housing 11A, a lower housing 11B, and a central housing 11C. The housing assembly 11 has an axial bore 12 therethrough for establishing communication between the diverter tool and the drilling/production liner. An annular recess 13 formed in the central housing 11C between the upper housing 11A and the lower housing 11B. The annular recess 13 has a diameter greater than the diameter of the axial bore 12.

Figure 3:
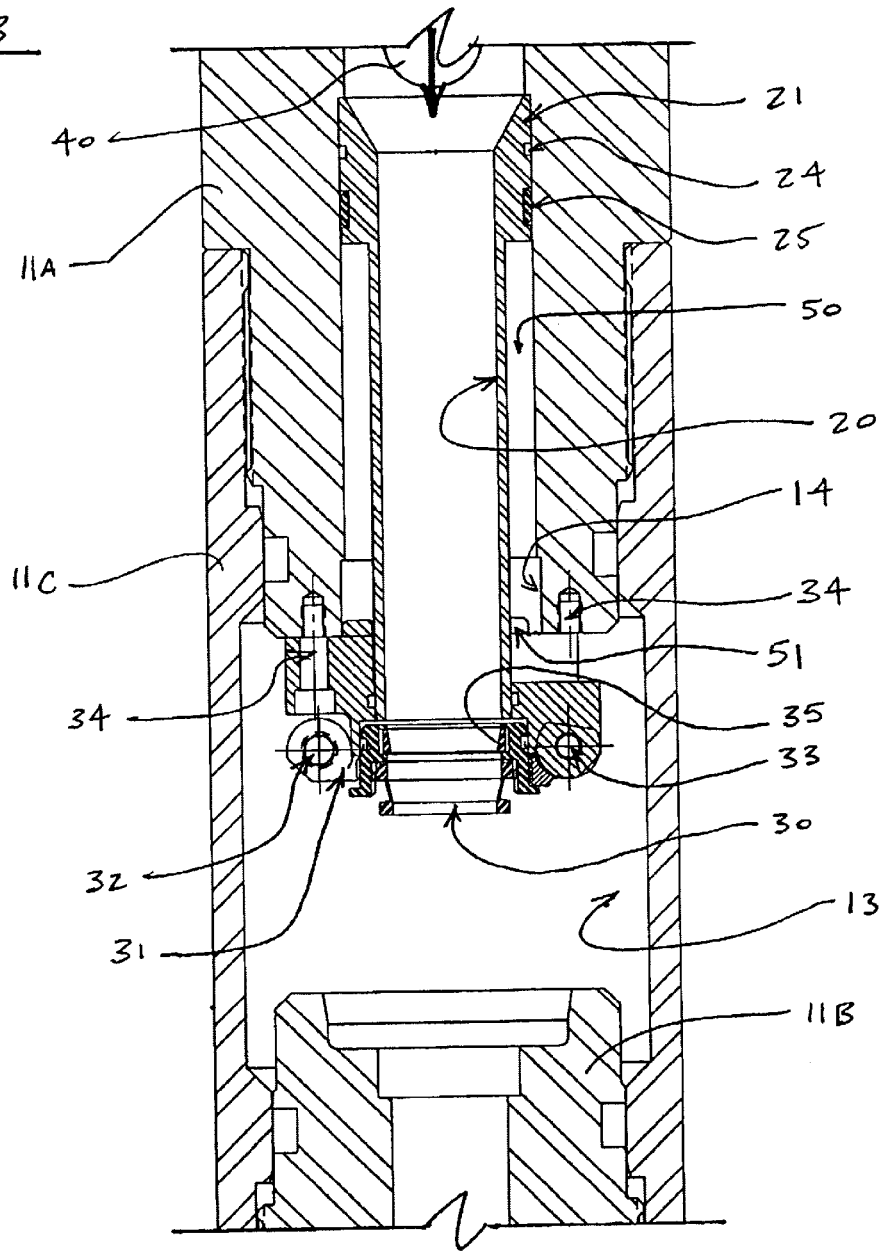
FIG. 3 is an enlarged section view of an embodiment of the present invention depicting a drop ball being released into the drop ball catcher.
Figure 4:
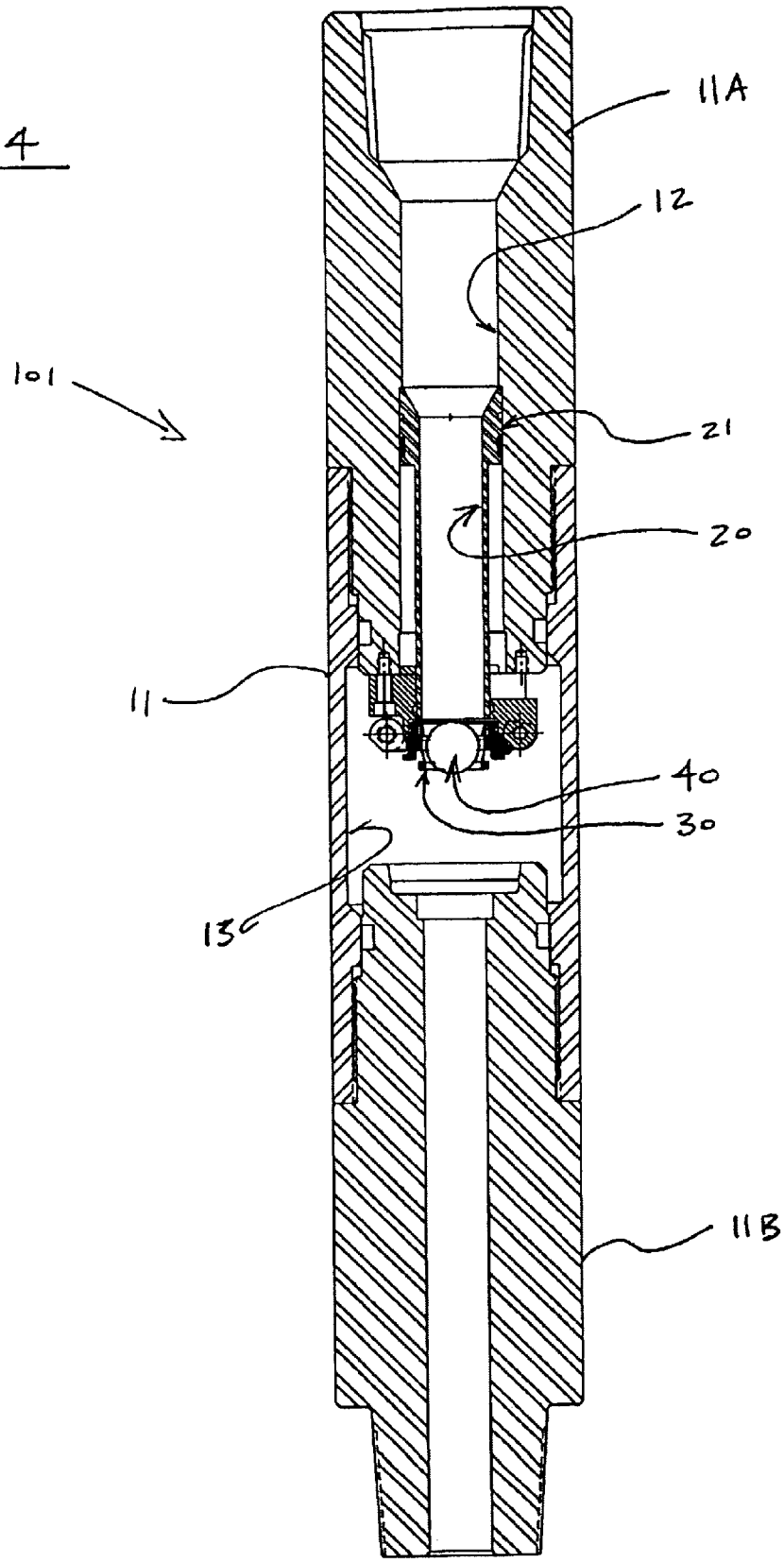
FIG. 4 is an elevation view of an embodiment of the present invention depicting the drop ball catcher apparatus receiving a drop ball.

With respect to FIGS. 2 and 3, the drop ball catcher apparatus of the present invention also includes a sliding sleeve 20 such as a dart guide tube having an upper end and a lower end residing within the axial bore 12 of the upper housing 11A above the annular recess 13. The sliding sleeve 20 has a diameter smaller than the diameter of the axial bore 12 of the housing assembly 11. The sliding sleeve 20 includes a protruding flange 21 formed on the outer surface and located at the upper end of the sliding sleeve. The flange 21 has a diameter equal to or slightly smaller than the diameter of the axial bore 12. The flange includes a seal 24, which is preferably an O-ring seal, between the sleeve 20 and the axial bore 12. The flange further includes a spring ring 25 for engaging a circumferential groove 14 formed near the lower end of the upper housing 11A. An annular volume 50 is formed below the flange 21 and between the sliding sleeve 20 and the axial bore 12 of the upper housing 11A.

Figure 5:
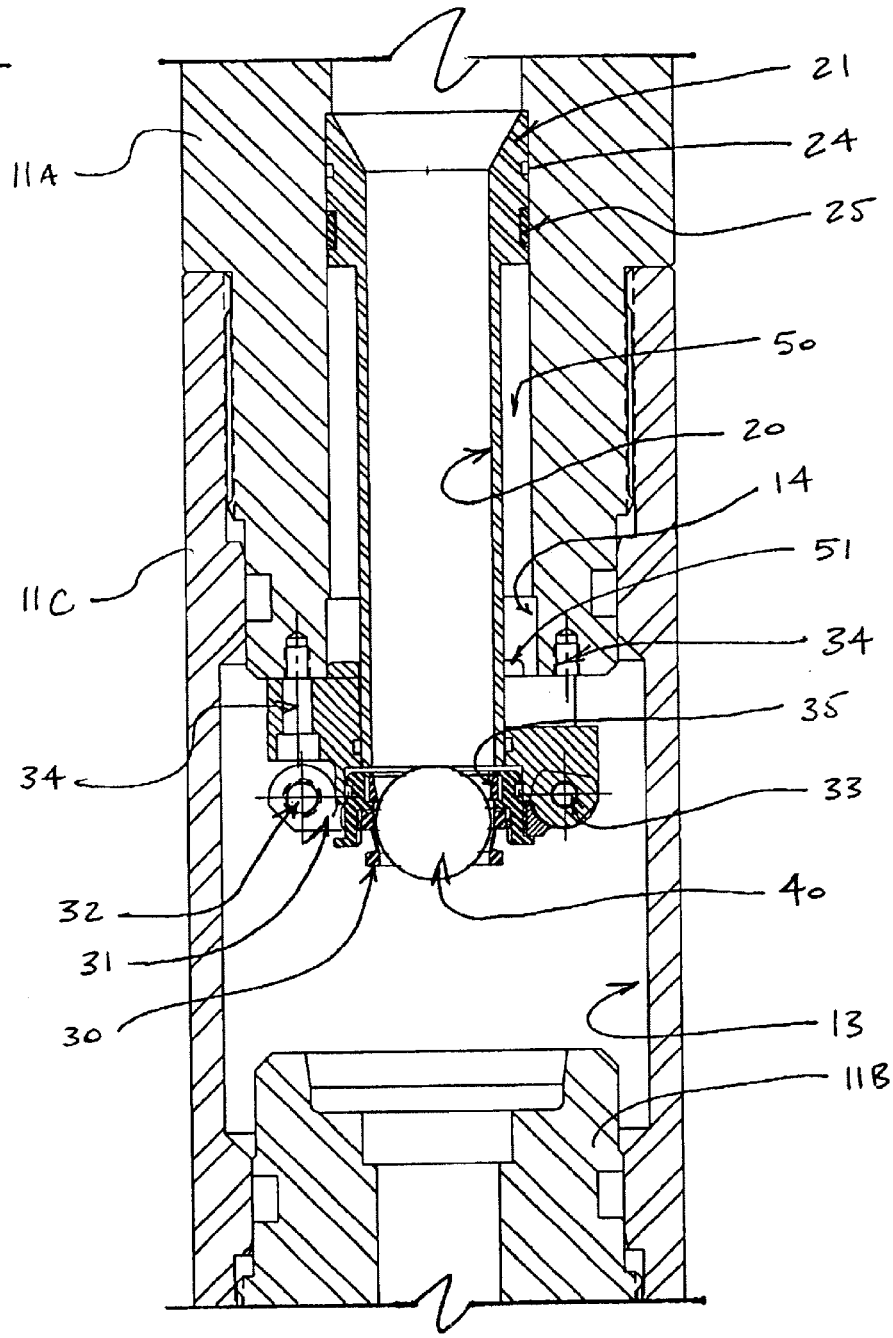
FIG. 5 is an enlarged section view of an embodiment of the present invention depicting the drop ball catcher apparatus receiving a drop ball.
Figure 6:
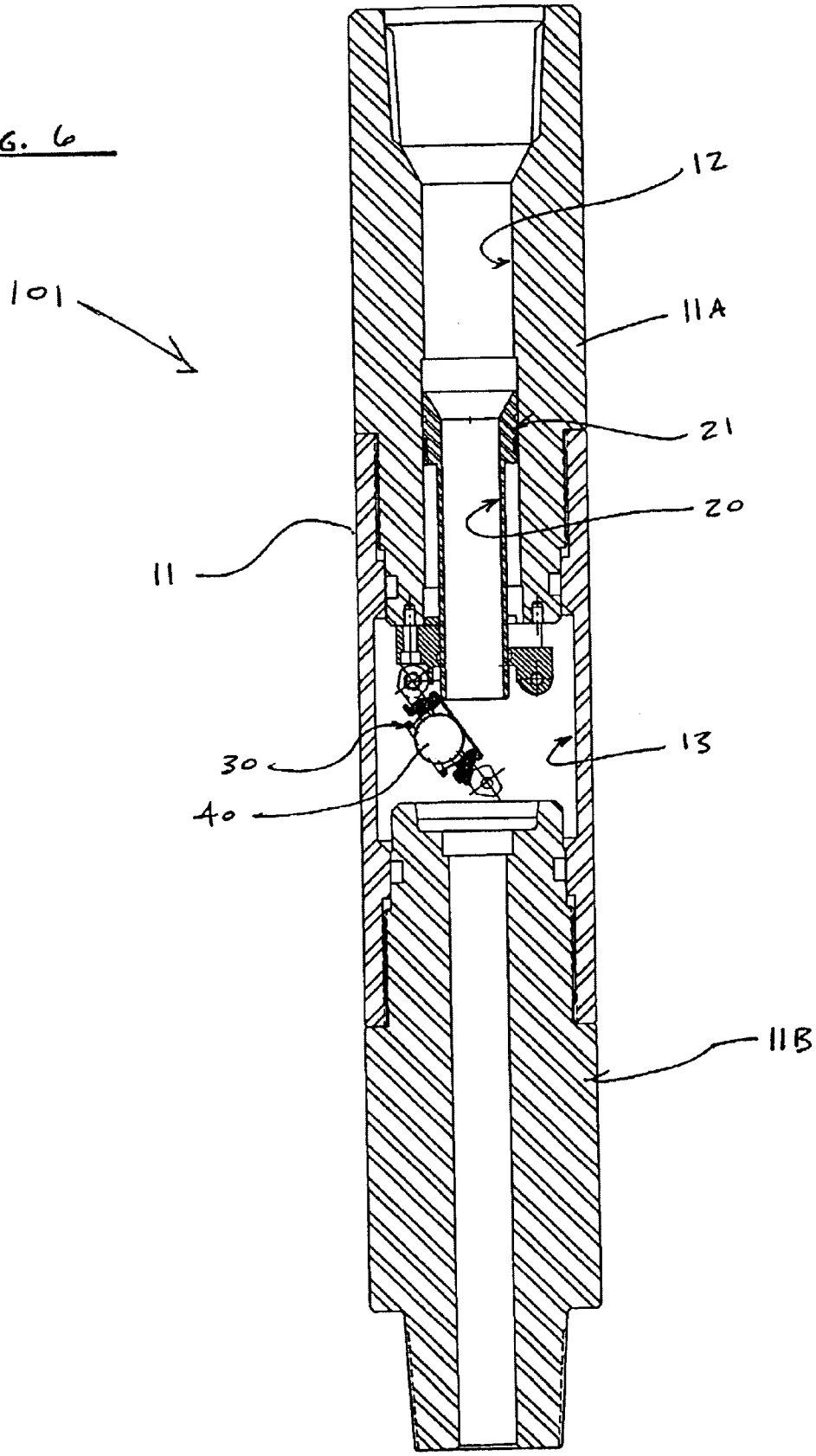
FIG. 6 is an elevation view of an embodiment of the present invention depicting the ball seat being rotated from an obstructed position to a recessed position.
Figure 7:
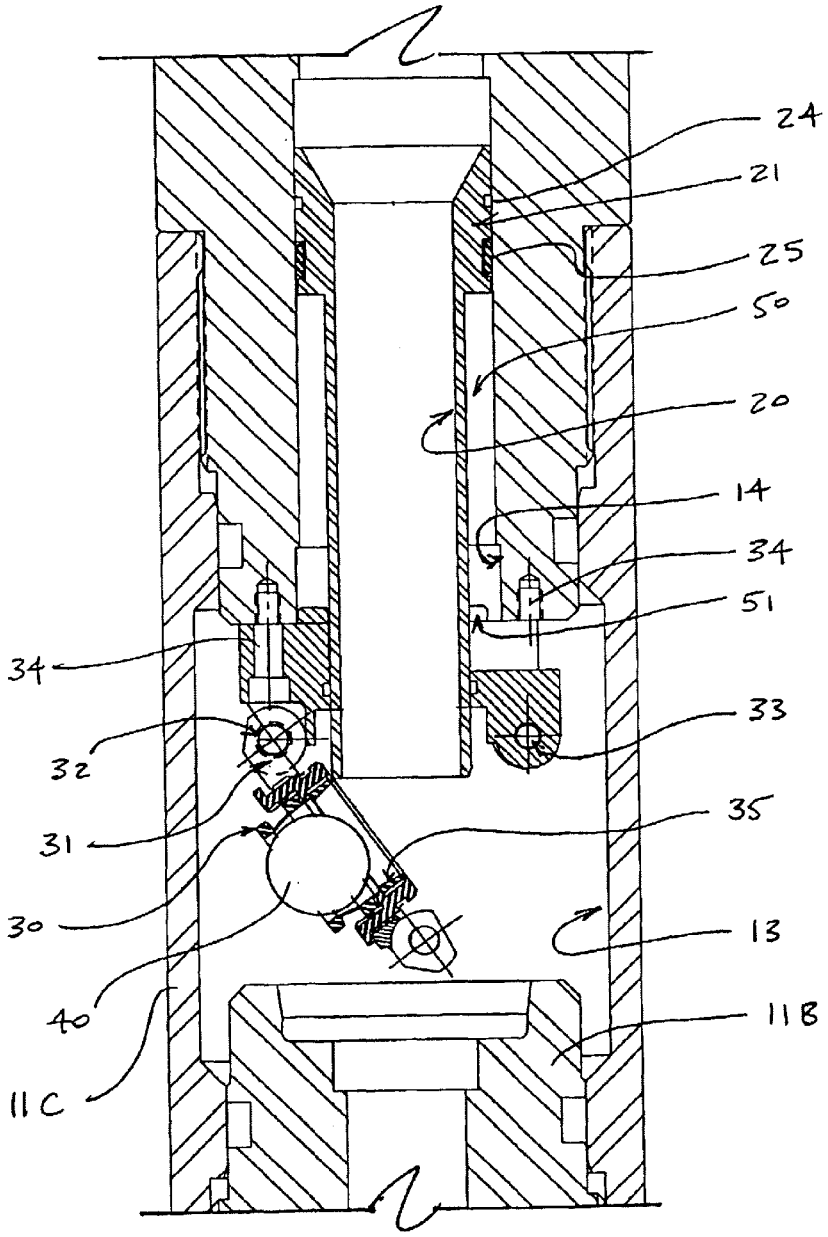
FIG. 7 is an enlarged section view of an embodiment of the present invention depicting the ball seat being rotated from an obstructed position to a recessed position.
Figure 8:
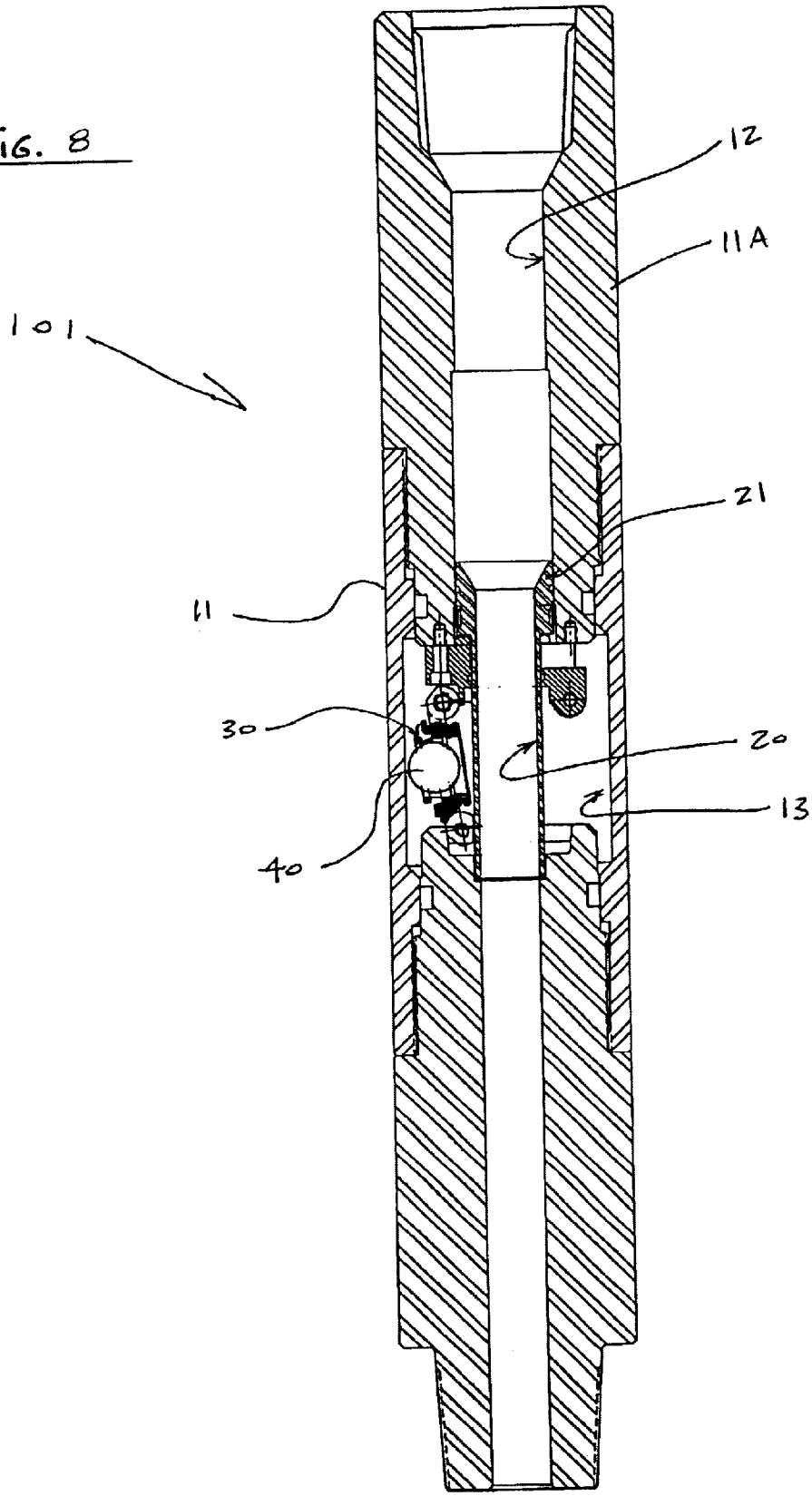
FIG. 8 is an elevation view of an embodiment of the present invention depicting the sliding sleeve being displaced axially downward to trap the drop ball in the annular recess.
Figure 9:
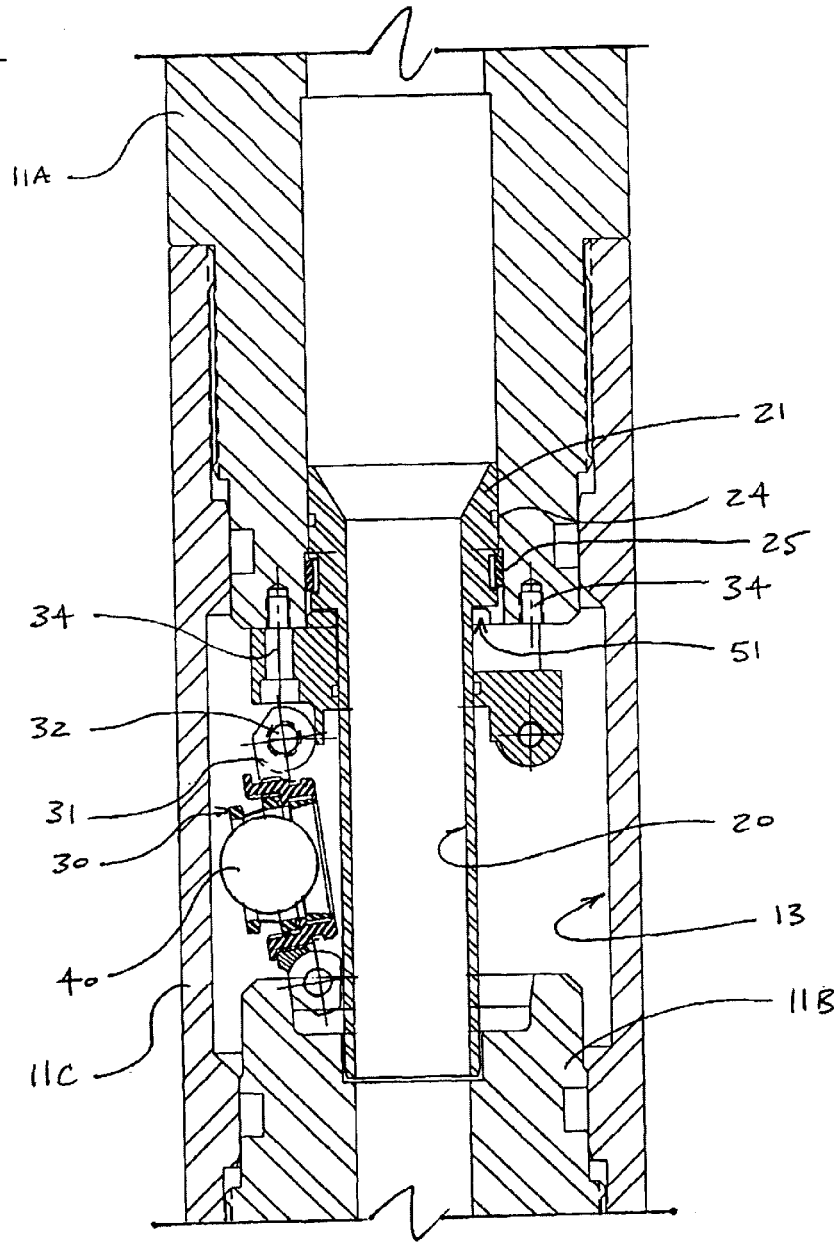
FIG. 9 is an enlarged section view of an embodiment of the present invention depicting the sliding sleeve being displaced axially downward to trap the drop ball in the annular recess.

With respect to FIG. 3, the drop ball catcher apparatus of the present invention further includes a ball seat 30 having an axial bore therethrough arranged below the lower end of the sliding sleeve 20. The ball seat further comprises a snap ring 35 for engaging a drop ball 40 (FIG. 5). The ball seat 30 is moveable between a first or "obstructed" position where the ball seat engages the sliding sleeve 20 (as shown in FIG. 3) to prevent the sliding sleeve from displacing axially downward and a second or "recessed" position where the ball seat is located within the recess 13 of the housing assembly 11 and out of engagement with the sliding sleeve (as shown in FIG. 8) to permit the sliding sleeve to displace axially downward.

In a preferred embodiment, the drop ball catcher apparatus comprises a bracket 31 for attaching the seat 30 to the upper housing 11A and a pin 32 on which the seat pivots between the first position and the second position. A shear pin 33 is used to latch the ball seat in the first position. The bracket 31 includes a bracket attachment device 34 to operatively connect the bracket to the upper housing 11A and a bore seal 52 to prevent incidental communication around the seat 30 when in the first position. A set of radial ports 51 are formed on the on the upper end of the bracket such that the annular volume 50 can vent into the annular recess 13 when the sliding sleeve 20 is displaced axially downward. The set of ports 51 prevents a pressure build-up in the annular volume which would resist the downward shifting of the sleeve 20. While this embodiment includes a shear pin to hold the ball seat in the first position, it is intended that any conventional connecting device can be used including but not limited to a latch, a snap, or a hook.

The drop ball catcher apparatus of the present invention also includes a drop ball 40 for interrupting communication through the axial bore 12 of the housing assembly 11 via the ball seat 30. In an embodiment of the present invention, the drop ball is located at the surface on a drilling rig and is dropped down the tubular string to shift the diverter tool. Once the diverter tool has been shifted, the drop ball is received by the drop ball catcher apparatus.

Referring now to FIGS. 2–9, the operation of the drop ball catcher apparatus is described. The drop ball catcher apparatus is operatively connected to the lower end of a downhole tool, such as a diverter tool, and is run down a borehole on a tubular string, such as a drill string. To activate the downhole tool, the drop ball 40 is dropped from the surface and into the downhole tool via the tubular string. Once the ball is used to activate the downhole tool, it is ejected from the tool and lands in the ball seat 30 of the drop ball catcher apparatus 101. The ball 40 is held in the ball seat 30 by the snap ring 35, and drilling fluid pressure is then increased above the drop ball 40 to a predetermined level to shear the shear pin 33 and release the bracket 31 of the ball seat 30. At this time, the bracket 31 rotates around the pivot pin 32. Once the ball catcher apparatus has rotated out of engagement with the sliding sleeve 20 and into the annular recess 13, the sliding sleeve is displaced axially downward. As the sliding sleeve shifts axially downward, drilling fluid is swept from the annular volume 50 by the flange 21 via the set of radial ports 51. The lower end of the sliding sleeve 20 engages the lower housing and the spring ring 25 protracts radially outward as it reaches the circumferential groove 14 thereby preventing the sliding sleeve from shifting axially upward. Once locked in place, the sliding sleeve 20 traps the drop ball 40 in the annular recess 13 and forms an unobstructed flow path through the housing assembly 11.

While an embodiment of the present invention is described with respect to a single drop ball catcher, it is intended that a plurality of drop ball catchers may be operatively connected in series to receive and stow drop balls ejected from a downhole tool requiring multiple drop ball activation.

Figure 11:
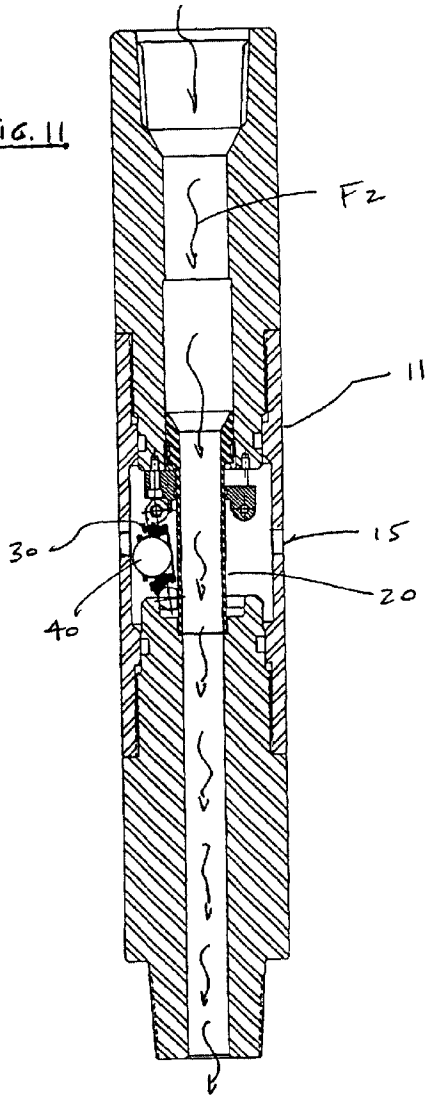
FIG. 11 is a section view of an embodiment of the present invention depicting the drop ball catcher apparatus integrated with a surge pressure reduction tool in the closed port position.
Figure 10:
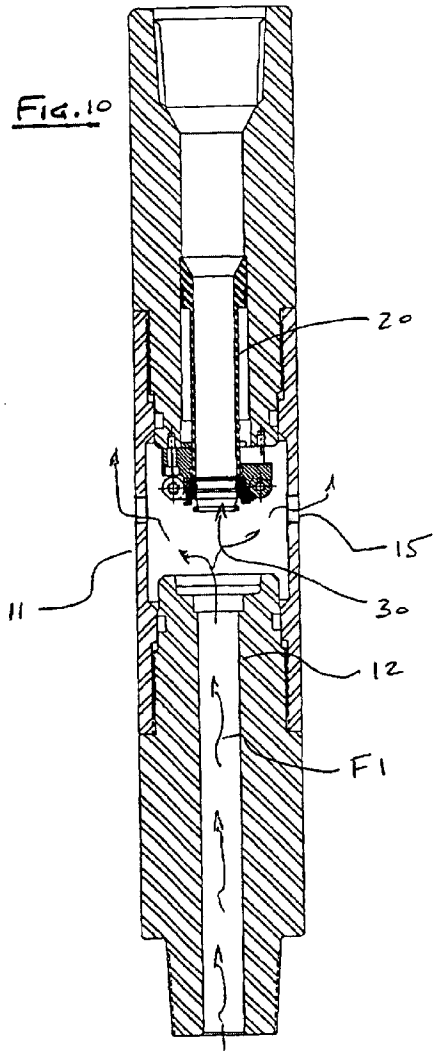
FIG. 10 is a section view of an embodiment of the present invention depicting the drop ball catcher apparatus integrated with a surge pressure reduction tool in the open port position.

In another embodiment of the present invention, the drop ball catcher may be integrated with a downhole tool—such as a diverter tool, liner hanger, or circulating tool—and used as a primary activation device. For example, FIGS. 10 and 11 show the drop ball catcher apparatus integrated with a surge pressure reduction diverter tool which may be used to run a drilling/production liner 103 (FIG. 1) down a borehole. The housing assembly 11 of the tool includes a set of flow holes 15 to facilitate surge pressure reduction as the tool is run on a drill string down a wellbore filled with drilling fluid. The sliding sleeve 20 is moveable between: (1) an open port position whereby a flow path F1 is formed to establish communication between the axial bore 12 of the housing assembly 11 and the annulus outside the housing assembly to facilitate surge pressure reduction (as shown in FIG. 10), and (2) a closed port position whereby a flow path F2 is formed to establish full bore communication via the tool (as shown in FIG. 11). When the sleeve is in the open port position, drilling fluid flows upward from the borehole (open hole) into the drilling/production liner, from the drilling/production liner to the running tool, from the running toll to the diverter tool, and from the diverter tool into an annular space between the drill string and the borehole (cased hole). When the sleeve is in the closed port position, the flow path is altered such that drilling fluid flows downward from the drilling rig to the drill string, from the drill string to the diverter tool, from the diverter tool to the running tool, from the running tool to the drilling/production liner, and from the drilling/production liner into the borehole (open hole). In this embodiment, the drop ball catcher apparatus as described above is used not only to catch and stow the ball, but also to activate the diverter tool to shift the sleeve axially downward from the open port position to the closed port position.

In the specification and appended claims, the term "operatively connected" is used to mean "in direct connection with" or "in connection with via another element;" the term "set" means "one or more elements;" and the term "dropped" is used to mean "released" or "pumped."

Moreover, in oilfield applications, a "drilling/production liner" and a "sub-sea casing" are tubular members which are run on drill pipe. The term "sub-sea casing" is used with respect to offshore drilling operations, while the term "drilling/production liner" is used with respect to both land and offshore drilling operations. For ease of reference in this specification, the present invention is described with respect to a "drilling/production liner." However, it should be appreciated that the present invention may also be used in connection with a sub-sea casing down a borehole. In the appended claims, the term "tubular member" is intended to embrace either a "drilling/production liner" or a "sub-sea casing."

What is claimed is:

1. Apparatus for use in receiving a drop ball from a downhole tool, comprising:

housing assembly having an upper end, a lower end, and an axial bore therethrough;

a ball seat which is located within the housing assembly for holding a drop ball;

a bracket to operatively connect the seat to the housing assembly, the bracket being moveable between a first position within the housing assembly where the seat receives the drop ball to interrupt communication via the axial bore of the housing assembly and a second position within the housing assembly where the seat and drop ball do not interrupt communication via the axial bore of the housing assembly; and apparatus to hold the bracket in the first position.

2. The apparatus of claim 1 further comprising a pin on which the bracket rotates between the first position and the second position.

3. Apparatus for use in receiving a drop ball from a downhole tool, comprising:

housing assembly having an upper end, a lower end, and an axial bore therethrough;

a ball seat which is located within the housing assembly for holding a drop ball;

a bracket to operatively connect the seat to the housing assembly, the bracket being moveable between a first position within the housing assembly where the seat receives the drop ball to interrupt communication via the axial bore of the housing assembly and a second position within the housing assembly where the seat and drop ball do not interrupt communication via the axial bore of the housing assembly;

a pin on which the bracket rotates between the first position and the second position; and a shear pin to hold the bracket in the first position.

4. The apparatus of claim 3 further comprising means for establishing a pressure above the drop ball which is sufficient to shear the shear pin and allow the bracket to rotate from the first position to the second position.

5. The apparatus of claim 4 wherein the downhole tool is suspended in a borehole on a tubular string and the upper end of the housing assembly is operatively connected to the downhole tool.

6. The apparatus of claim 5 wherein the downhole tool is a diverter tool for facilitating surge pressure reduction.

7. The apparatus of claim 6 wherein the lower end of the housing assembly is connected to a hanger for installing drilling/production liners in the borehole.

8. Apparatus for receiving a drop ball from a downhole tool suspended on a tubular string in a borehole, said apparatus comprising:

a housing assembly with an upper end operatively connected to the bottom end of the tubular string and a lower end, said housing assembly having an axial bore formed therethrough having a first diameter and an annular recess formed therein having a second diameter which is greater than the first diameter of the axial bore;

a sleeve arranged within the housing assembly having an upper end and a lower end;

a ball seat for holding a drop ball;

a bracket for operatively connecting the seat to the housing assembly, said bracket being moveable between a first position where the seat engages the lower end of the sleeve to receive the drop ball and to prevent the sleeve from shifting axially downward and a second position where the seat and received drop ball are moved into the annular recess and out of engagement with the sleeve; and apparatus for holding the bracket in the first position.

9. The apparatus of claim 8 further comprising a drop ball being dropped into the ball seat via the tubular string.

10. The apparatus of claim 9 wherein the ball seat further comprises a snap ring attached to the upper end of the seat for locking the drop ball in the ball seat.

11. The apparatus of claim 10 further comprising a pin for rotating the bracket between the first position and the second position.

12. The apparatus of claim 11 wherein the apparatus for holding the bracket in the first position is a shear pin.

13. The apparatus of claim 12 further comprising means for establishing a pressure above the drop ball which is sufficient to shear the shear pin and allow the bracket to rotate from the first position to the second position.

14. The apparatus of claim 13 wherein the tubular string is a drill string.

15. The apparatus of claim 14 further comprising a drilling/production liner operatively connected to the lower end of the housing assembly.

16. The apparatus of claim 15 wherein the housing assembly further comprises a set of flow holes formed therein for establishing communication between the axial bore of the housing assembly and the borehole.

17. The apparatus of claim 16 wherein the sleeve is moveable between an open port position where the set of flow holes of the housing assembly is not blocked by the sleeve and a closed port position where the set of flow holes is blocked by the sleeve.

18. The apparatus of claim 17 wherein the sleeve being in the open port position creates a flow path for drilling fluid to flow upward from the borehole into the drilling/production liner, from the drilling/production liner into the diverter tool, and from the diverter tool into an annular space between the drill string and the borehole.

19. The apparatus of claim 18 wherein the sleeve being in the closed port position creates a path for drilling fluid to flow downward from a drilling rig at the surface to the drill string, from the drill string to the diverter tool, from the diverter tool to drilling/production liner, and from the drilling/production liner into the borehole.

20. The apparatus of claim 13 wherein the housing assembly further comprises an upper housing and a lower housing.

21. The apparatus of claim 20 wherein the annular recess is located between the upper housing and the lower housing.

22. The apparatus of claim 21 further comprising means for establishing a pressure above the upper end of the sleeve to displace the sleeve axially downward such that the sleeve engages the lower housing.

23. The apparatus of claim 22 further comprising:

a circumferential groove formed in the axial bore at the lower end of the upper housing; and a spring ring arranged on the upper end of the sleeve, said spring ring for engaging the circumferential groove when the sleeve is displaced axially downward.

24. The apparatus of claim 13 further comprising:

a protruding flange formed on the upper end of the sleeve, said flange having a diameter greater than the diameter of the sleeve;

an annular volume formed between the sleeve and the axial bore of the housing assembly and below the protruding flange; and a set of ports formed on the upper end of the bracket for establishing communication between the annular volume and the annular recess.

* * * * *